US012528658B2

(12) United States Patent
Jaquet et al.

(10) Patent No.: US 12,528,658 B2
(45) Date of Patent: Jan. 20, 2026

(54) REEL SUPPORT ASSEMBLY FOR A WEB MATERIAL PROCESSING MACHINE AND HOTFOIL STAMPING MACHINE

(71) Applicant: BOBST MEX SA, Mex (CH)

(72) Inventors: Bernard Jaquet, Rue (CH); Christophe Ruchet, Préverenges (CH)

(73) Assignee: BOBST MEX SA, Mex (CH)

( * ) Notice: Subject to any disclaimer, the term of this patent is extended or adjusted under 35 U.S.C. 154(b) by 156 days.

(21) Appl. No.: 18/563,564

(22) PCT Filed: May 30, 2022

(86) PCT No.: PCT/EP2022/064589

§ 371 (c)(1),
(2) Date: Nov. 22, 2023

(87) PCT Pub. No.: WO2022/253746

PCT Pub. Date: Dec. 8, 2022

(65) Prior Publication Data

US 2024/0239626 A1 Jul. 18, 2024

(30) Foreign Application Priority Data

Jun. 3, 2021 (EP) ..... 21177628

(51) Int. Cl.
*B65H 19/12* (2006.01)

(52) U.S. Cl.
CPC . *B65H 19/126* (2013.01); *B65H 2301/41346* (2013.01); *B65H 2301/413526* (2013.01);
(Continued)

(58) Field of Classification Search
CPC .... B65H 2301/4182; B65H 2301/4185; B65H 2301/413526; B65H 16/06; B65H 19/126; A47K 10/03; A47K 10/40
(Continued)

(56) References Cited

U.S. PATENT DOCUMENTS 2,405,637 A * 8/1946 Behrens ..... B65H 19/10 242/596.5
3,381,912 A * 5/1968 Huck ..... B65H 23/0216 242/596.5
(Continued)

FOREIGN PATENT DOCUMENTS

CH 433397 A * 4/1967 ..... B65H 16/06
CN 102666326 A 9/2012
(Continued)

*Primary Examiner* — Anna M Momper
*Assistant Examiner* — Ermia E. Melika
(74) *Attorney, Agent, or Firm* — Bookoff McAndrews, PLLC

(57) ABSTRACT

A reel support assembly (14) for a web material processing machine is described. The reel support assembly (14) comprises a support frame (16) and at least a first support arm unit (34*a*) having at least one holding stub (40) for mounting a reel (12) on the first support arm unit (34*a*). Furthermore, the reel support assembly (14) comprises an elevator unit (24) having a support element (26) on which a reel (12) may be placed. The support element (26) is supported on the support frame (16) in a vertically movable manner. Additionally, a hotfoil stamping machine (10) is presented which comprises such a reel support assembly (14). The reel support assembly (14) is arranged at an upstream end of the hotfoil stamping machine (10) with respect to a web travelling direction.

20 Claims, 9 Drawing Sheets

Figure 1:
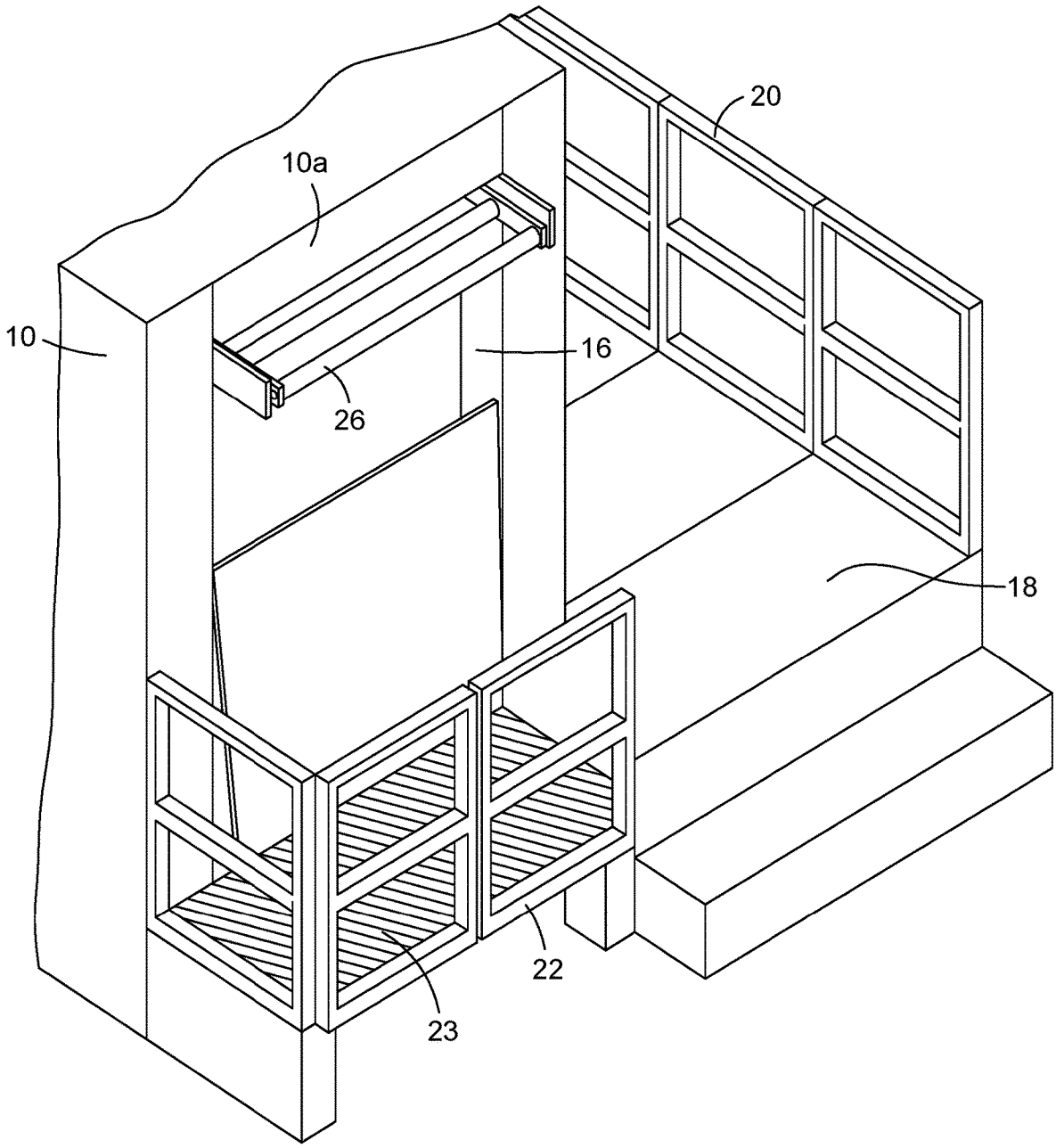

(52) U.S. Cl.
CPC ..... *B65H 2301/41374* (2013.01); *B65H 2301/4186* (2013.01)

(58) Field of Classification Search
USPC ..... 242/558, 559, 559.4, 596, 596.1, 596.4, 242/596.5
See application file for complete search history.

(56) References Cited

U.S. PATENT DOCUMENTS

| | | | | | |
|---|---|---|---|---|---|
| 3,695,538 | A | | 10/1972 | Lindstaedt | |
| 4,903,910 | A | * | 2/1990 | Tamura | B65H 19/126 242/573 |
| 5,004,173 | A | | 4/1991 | Kawai | |
| 5,004,174 | A | * | 4/1991 | Deutschle | B65H 19/126 242/550 |
| 5,060,878 | A | * | 10/1991 | Hutzenlaub | B65H 23/02 242/129.51 |
| 6,402,083 | B1 | * | 6/2002 | Horn | B65H 19/123 242/561 |
| 6,604,704 | B2 | * | 8/2003 | Kiprowski | B66C 1/54 242/559.1 |
| 12,114,813 | B2 | * | 10/2024 | Osborne, Jr. | A47K 10/3656 |
| 2003/0089816 | A1 | * | 5/2003 | Hanson | B65H 19/1889 242/559 |
| 2004/0206848 | A1 | * | 10/2004 | Martinez | B65H 19/126 242/559.4 |
| 2005/0189449 | A1 | * | 9/2005 | Bilskie | B65H 19/126 242/559.1 |
| 2005/0236511 | A1 | * | 10/2005 | Martin | B65H 16/103 242/564.5 |
| 2015/0075394 | A1 | * | 3/2015 | Sun | B65H 16/106 242/564.5 |
| 2017/0225492 | A1 | * | 8/2017 | Culubret | B65H 23/188 |
| 2018/0327208 | A1 | * | 11/2018 | Chretien | B41F 13/02 |
| 2022/0041393 | A1 | * | 2/2022 | Lazzarin | B65H 19/30 |

FOREIGN PATENT DOCUMENTS

| | | | | | |
|---|---|---|---|---|---|
| CN | 105883482 | A | * | 8/2016 | B65H 54/54 |
| CN | 108285054 | A | | 7/2018 | |
| CN | 208666668 | U | | 3/2019 | |
| CN | 110203772 | A | * | 9/2019 | B65H 19/123 |
| DE | 3912328 | A1 | | 10/1989 | |
| DE | 4330717 | C2 | * | 3/1998 | B65H 19/102 |
| DE | 10055478 | A1 | * | 5/2002 | B65H 75/2484 |
| EP | 1433729 | A1 | * | 6/2004 | B65H 19/18 |
| ES | 3006833 | T3 | * | 3/2025 | G03G 15/2021 |
| GB | 1313855 | A | | 4/1973 | |
| JP | 58078940 | A | * | 5/1983 | B65H 19/126 |
| JP | H11314812 | A | | 11/1999 | |
| JP | 2004210020 | A | | 7/2004 | |
| JP | 4922842 5 | | | 4/2012 | |
| JP | 2013142031 | A | | 7/2013 | |
| JP | 6641039 | B1 | * | 2/2020 | B41J 15/042 |
| JP | 2024078940 | A | | 6/2024 | |
| TW | 200300124 | A | * | 5/2003 | B65H 19/126 |

* cited by examiner

REEL SUPPORT ASSEMBLY FOR A WEB MATERIAL PROCESSING MACHINE AND HOTFOIL STAMPING MACHINE

CROSS-REFERENCE TO RELATED APPLICATION(S)

This application is a National Stage Application under 35 U.S.C. § 371 of International Application No. PCT/EP2022/064589, filed on May 30, 2022, which claims priority to European Application No. 21177628.1, filed on Jun. 3, 2021, the entireties of which are incorporated herein by reference.

The invention relates to a reel support assembly for a web material processing machine, especially a hotfoil stamping machine, comprising a support frame and at least a first support arm unit, having at least one holding stub for mounting a reel on the first support arm unit, wherein the first support arm unit is directly supported on the support frame.

The invention is also directed to a hotfoil stamping machine comprising such a reel support assembly.

Reel support assemblies and hotfoil stamping machines equipped therewith are known. In this context, a reel usually comprises a reel core on which a web, e.g. a foil to be processed in a hotfoil stamping machine is wound.

The first support arm unit is used for supporting a reel such that the web wound on the reel, e.g. the foil, can be processed within the hotfoil stamping machine.

Due to the finite amount of web being generally wound on a reel, the reels need to be exchanged from time to time, when operating the reel support assembly and a corresponding hot foil stamping machine.

Very often the reels are heavy such that they cannot be manipulated manually.

Consequently, it is known to use a hoist, a winch or a cart with lifting means for bringing the reel into cooperation with the holding stub, i.e. for loading the reel into the reel support assembly. The same is true for unloading the reel from the reel support assembly.

GB 1 313 855 A discloses a reel loading system with a support that can raise the reels to align them with a carrier comprising two stubs for grabing the reel. The reels are then transported by a horizontal carrier tube with a cantilever arm assembly. Said assembly is held from one side by a vertical tube that moves on three rails.

The objective of the present invention is to further improve known reel support assemblies. In particular, the exchange of reels shall be facilitated.

The problem is solved by a reel support assembly of the type mentioned above, which comprises an elevator unit having a support element on which a reel may be placed, wherein the support element is supported on the support frame in a vertically movable manner. Since the support element of the elevator unit is supported on the frame of the reel support assembly, the elevator unit is integrated into the reel support assembly. Thus, a reel to be mounted on the first support arm unit may be provided at a level relatively close to a factory floor. The reel can then be lifted into a position where it can be mounted on the support stub of the first support arm unit. Thus, the reel support assembly is adapted for bringing a reel which is to be exchanged into a position which is easily reachable. This is especially the case when comparing the reel support assembly according to the invention with a known reel support assembly. As a consequence thereof, reels can be exchanged with a comparatively low effort and within a comparatively short time. Furthermore, it is not necessary to lift or lower the reel using means external to the reel support assembly. There is especially no need to use a winch, a hoist or a cart having lifting means. Consequently, the mounting and dismounting of a reel is further facilitated.

The support element may be adapted for selectively assuming a loading state in that the support element is positioned on a ground level or adjacent to a lower half of the support frame. The support element may alternatively or additionally be adapted for assuming an alignment state in that the support element is positioned such that a reel supported on the support element is centered with respect to the holding stub of at least the first support arm unit. Alternatively or additionally, the support element is adapted for assuming a storage position in that the support element is positioned above the alignment state and outside a range of motion of at least the first support arm unit.

Depending on the specific application a platform, a gate, a fence and/or a handrail may be provided in the direct vicinity of the reel support assembly. In such a case one or more of these installations may be adapted for being withdrawn in order not to interfere with the support element of the elevator unit. For example, one or more of these installations may be adapted for being selectively folded or rotated out of the way. This especially applies to the support element being in the loading position.

The reel support assembly may comprise a second support arm unit having at least one holding stub for mounting a reel on the second support arm unit, wherein the second support arm unit is supported on the support frame. Preferably, the second support arm unit is supported directly on the support frame, i.e., without any intermediate structure. Furthermore, the second support arm unit is arranged opposite the first support arm unit such that a reel can be supported between the first support arm unit and the second support arm unit. Thus, the reel can be supported in a very reliable and secure manner. Preferably, the second support arm unit is movable in synchronization with the first support arm unit. Thus, the first support arm unit and the second support arm unit always are in corresponding position.

Preferably, the first support arm unit and/or the second support arm unit is pivotably and/or translatorily supported on the support frame. Thus, when loading or unloading a reel, the first support arm unit and/or the second support arm unit can be pivoted and/or translated into a loading position in which it is configured for receiving a reel which is to be mounted on the holding stubs. In this position the first support arm unit and/or the second support arm unit and the corresponding holding stubs are accessible from outside the reel support assembly and the hotfoil stamping machine. When the reel is mounted on the corresponding support stubs, the first support arm unit and/or the second support arm unit is pivoted and/or translated into an operational position wherein the holding stubs and the reel mounted thereon are arranged such that the web wound on the reel, e.g. the foil, can be processed. In this context, a reel being mounted on the holding stubs is not accessible for loading or unloading from outside the reel support assembly when the first support arm unit and/or the second support arm unit is in the operational position. A reel may be dismounted and withdrawn from the reel support assembly in an analogous manner. In summary, the holding stubs are easily accessible when the first support arm unit and/or the second support arm unit is in the loading position. This further facilitates the loading and unloading of reels.

According to an embodiment, each of the support arm units comprises a first arm piece being rotatably supported on the support frame and a second arm piece being slidably supported on the first arm piece. Thus, the support arm units are structurally simple. Especially the separation of the sliding mechanism and the pivoting mechanism renders the support arm assembly reliable in operation. Additionally, the support arm assemblies can be produced and assembled with comparatively low effort.

According to an embodiment, each of the support arm units comprise a sliding rail and one or several arm pieces slidably supported on the support frame by the sliding rail. When using several arm pieces, each arm piece is slidingly supported on the next arm piece. Thus, the support arm units are structurally simple. Additionally, the support arm assemblies can be produced and assembled with comparatively low effort. According to a variant, the arm pieces are connected to the support frame via two substantially parallel sliding rails. Such a configuration is especially well adapted for supporting high loads.

Preferably, the first arm piece and the second arm piece are connected via a sliding rail being oriented along a direction of slidable support of the respective support arm unit. A sliding rail is structurally simple and operationally reliable. Sliding rails can especially be adapted for supporting high loads.

According to a variant, the first arm piece and the second arm piece are connected via two substantially parallel sliding rails. Such a configuration is especially well adapted for supporting high loads.

According to an embodiment, each of the support arm units may comprise at least two holding stubs for respectively mounting a reel to the support arm unit. This means that each of the support arm units is adapted for carrying at least two reels. In a case in which a first support arm unit and a second support arm unit are used, they are able to support two reels between them. Consequently, the reel support assembly can be used for providing reels to processes needing two different kinds of reels, e.g. differing in the kind of web wound on the reel. In the extended position of the support arm units reels mounted on both of the holding stubs are easily accessible.

In a variant, the holding stubs are movable in a direction substantially corresponding to their middle axis such that the stubs can be selectively extended into cooperation with a reel to be mounted on the respective support arm unit and withdrawn therefrom. Thus, a reel may be mounted on the holding stubs in a quick and easy manner. The same is true for dismounting the reel from the holding stubs.

The holding stubs may be supported on the respective support arm unit via a rail extending substantially parallel to the middle axis of the respective holding stub. Again, a rail is a simple and reliable structure for supporting the holding stubs. The rail is especially well adapted for supporting heavy loads, i.e. heavy reels. The fixation on the rail allows to mount reels with varying width. It also allows to position a reel along a direction parallel to said rail (i.e., along the width of the machine), to align a narrow reel made of foil with the position where the foil must be stamped on its support. Having several stubs movable in a direction substantially corresponding to their middle axis also allows to mount several (narrow) reels along the same rail. Please note that a light, narrow reel can be mounted using a single stub, while a wider, heavier reels needs a sub on each of its side.

In a variant in which the reel support assembly comprises a first support arm unit and a second support arm unit the rail on which the holding stubs are supported may extend from the first support arm unit to the second support arm unit and a holding stub being associated with the first support arm unit may be supported at an associated end of the rail. A holding stub being associated with the second support arm unit may be supported at an opposite end associated with the second support arm unit.

In an embodiment, the reel support assembly comprises at least one safeguard bar selectively occupying a space into which an incorrectly mounted stub for supporting a reel may be located, or may be moved. Thus, it can be guaranteed that a reel including its support stub will not collide with other objects when the reel support assembly is moved from the loading position into operational position or vice versa. In a preferred embodiment, the operator has the possibility to slightly adjust the position of the reel along its axis when the reel it is operational position, thus the presence a set of safeguard bars close to the operational position to ensure that the reel was not displaced off-bounds prior to a move back to the loading position. Thus, the reel can be securely moved within the reel support assembly.

The support element may be coupled to the support frame via a chain drive or a belt drive. Thus, the motion for lifting and lowering the support element is generated by the chain drive or the belt drive. Thus, the support element can be moved in a reliable and precise manner.

Preferably, the support element is horizontally movable. This kind of movability may be used in order to align a reel supported thereon with a holding stub of at least one of the support arm units. Moreover, this kind of movability may be used to pass by a reel being already arranged in the reel support assembly. Thus, a reel loaded on the support element can be mounted and dismounted form the holding stub in a quick and easy manner.

In a variant, the elevator unit comprises a brake unit which is normally closed such that the support element is only movable if the brake unit assumes an activated condition. Preferably, two brake units are provided, one on each side of the elevator unit. Thus, the elevator unit of the reel support assembly may be operated in a particularly safe manner. The elevator unit can only be moved if the brake units are specifically activated. Otherwise the elevator unit is render immovable by the brake unit.

The problem is additionally solved by a hotfoil stamping machine of the type mentioned above, comprising a reel support assembly according to the invention, wherein the reel support assembly is arranged at an upstream end of the hotfoil stamping machine with respect to a web travelling direction. For such a hotfoil stamping machine, reels having web to be processed wound thereon can be inserted and withdrawn from the hotfoil stamping machine in a quick and easy manner. Consequently, the hotfoil stamping machine can be operated in an efficient manner since change-over times are reduced.

According to a variant, a backside of the reel support assembly, i.e. a side of the reel support assembly being opposed to a side facing the remaining portions of the hotfoil stamping machine, may be equipped with a rolling shutter, a door or a sliding window. The rolling shutter, the door or the sliding window can selectively close/protect the backside of the reel support assembly. Consequently, the components of the reel support assembly may be separated from an environment, if desired. When needed, the rolling shutter can be opened in order to access an interior of the reel support assembly or in order to exchange a reel.

Preferably, a support frame of the hotfoil stamping machine serves as a support frame of the reel support assembly. Thus, the support frame is shared. The hotfoil stamping machine thus is structurally simple and has a relatively small footprint on a factory floor.

Figure 2:
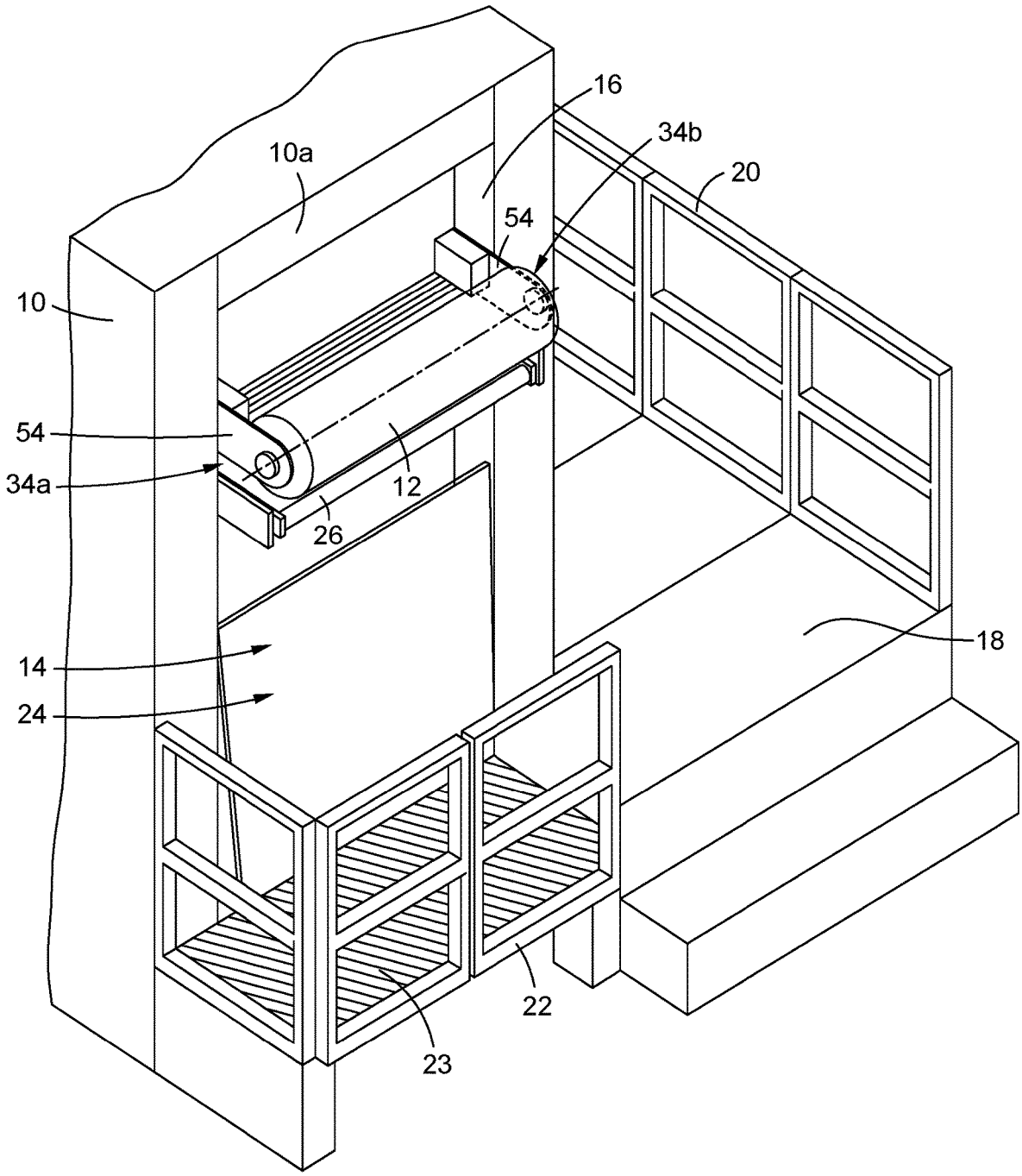
Figure 3:
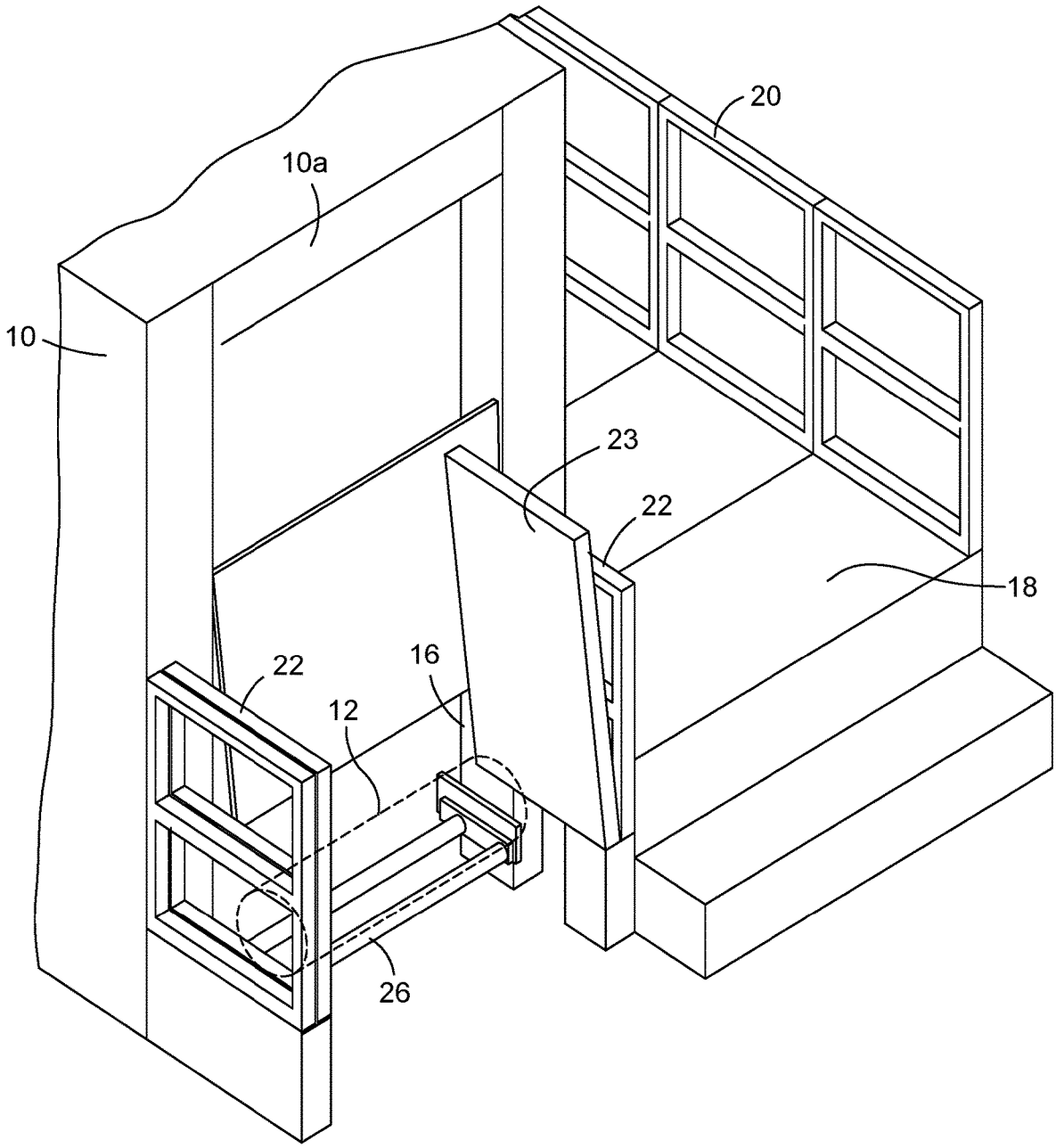
Figure 4:
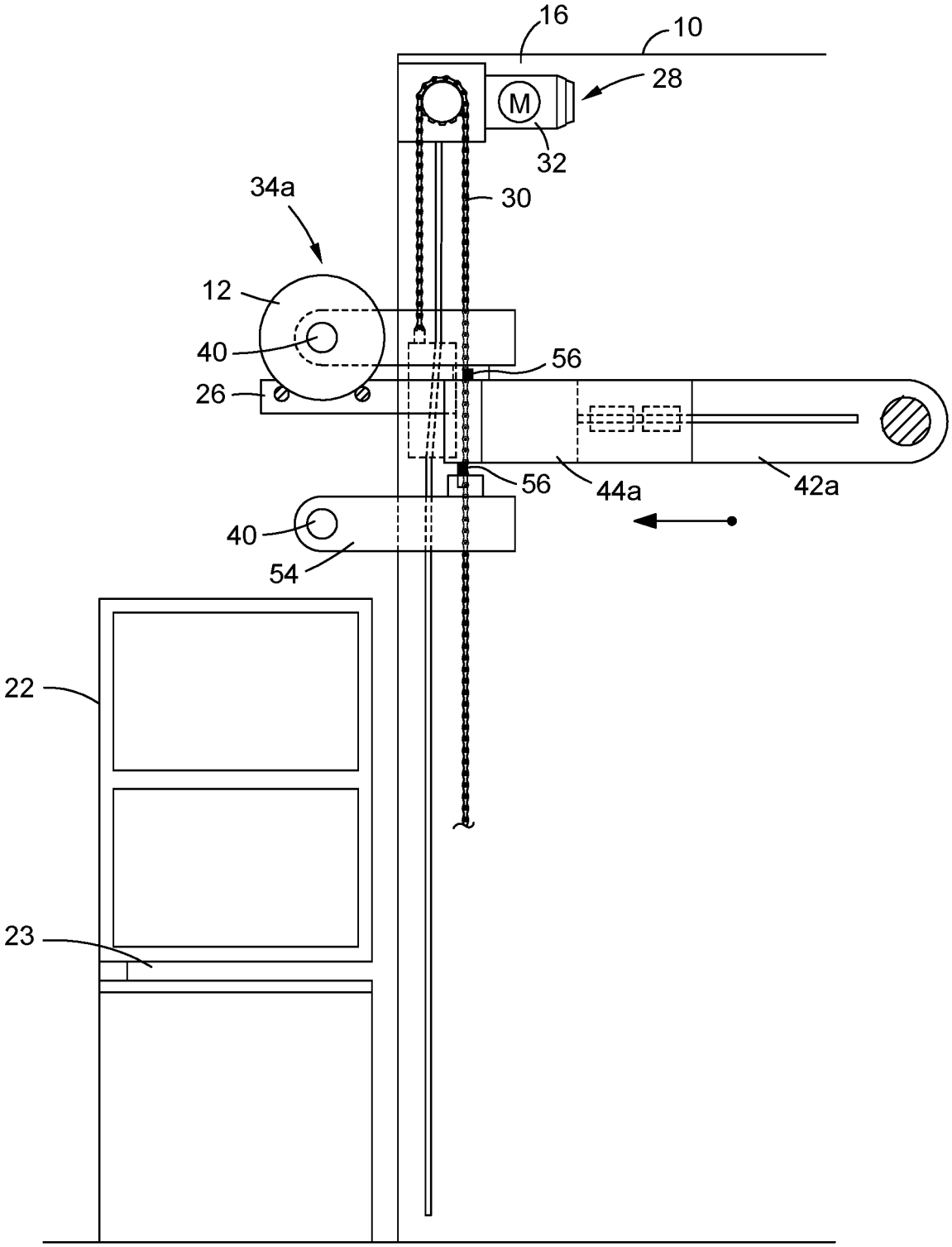
Figure 5:
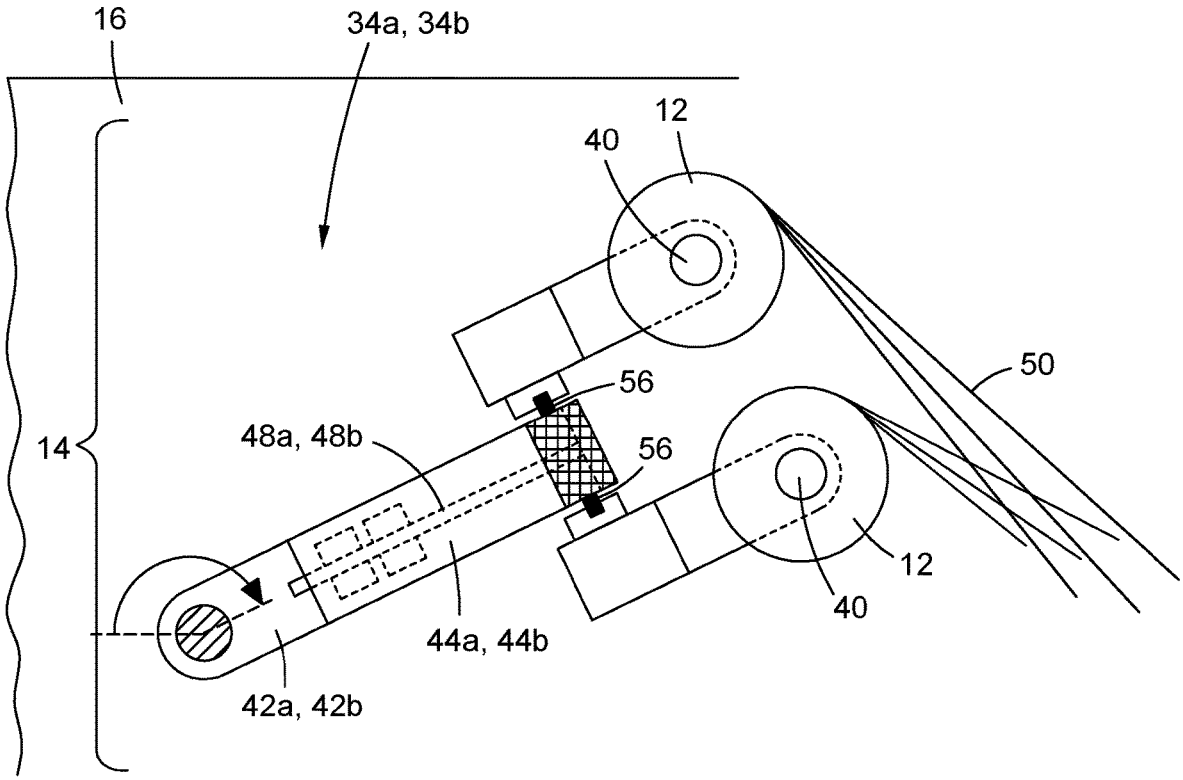
Figure 6:
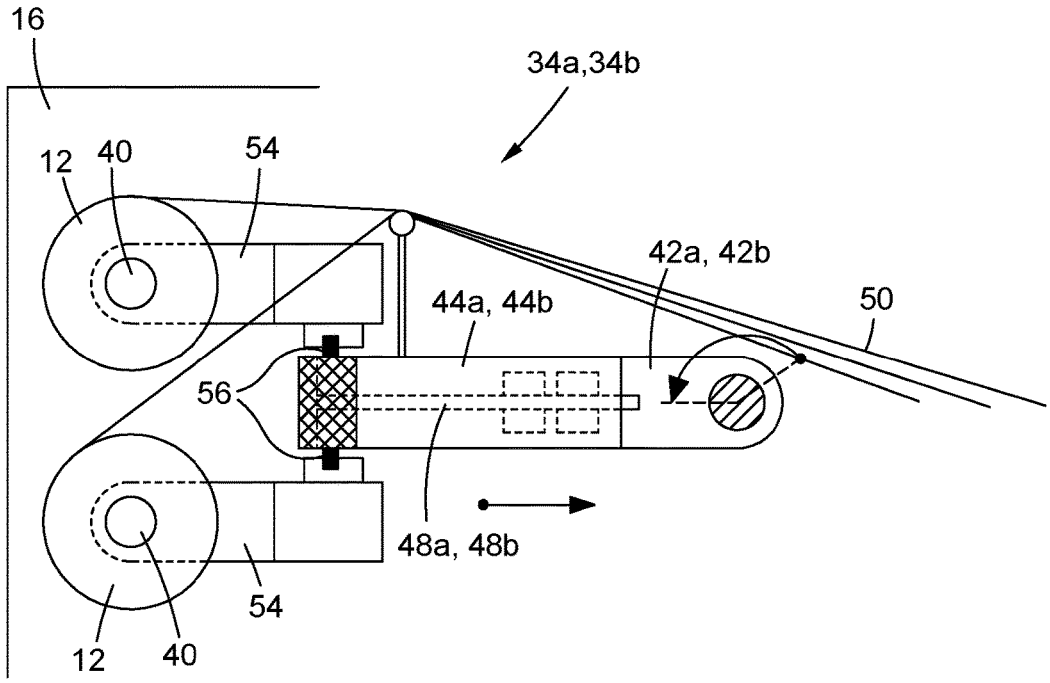
Figure 7:
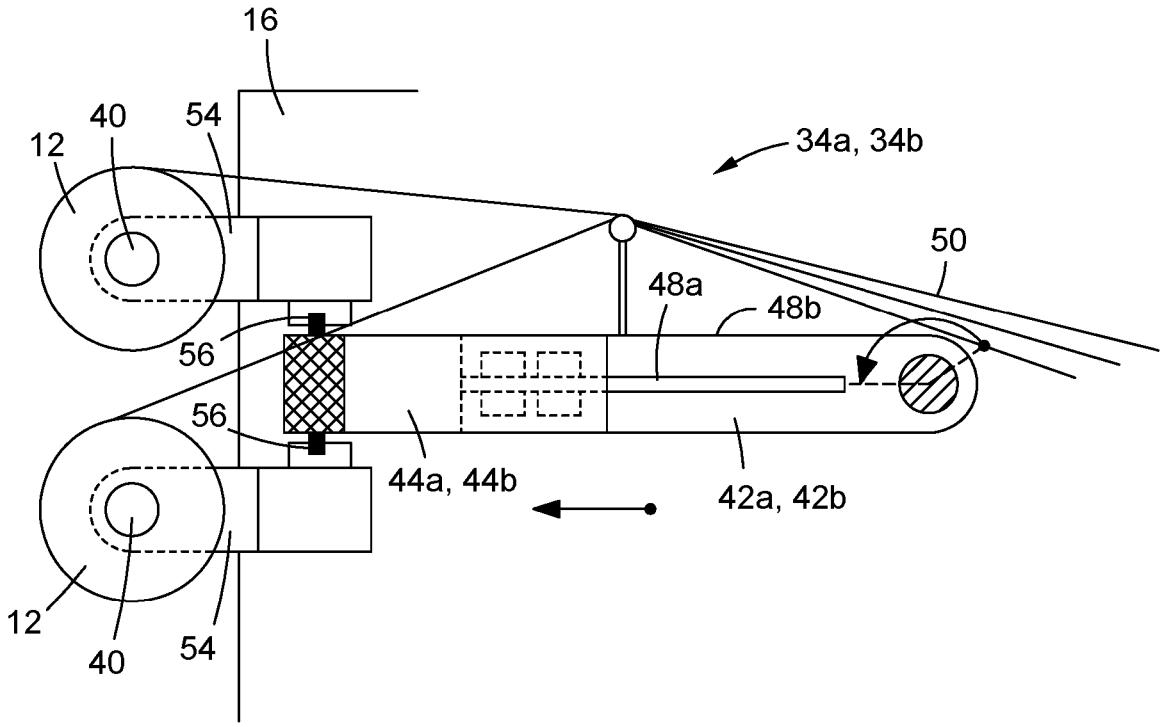
Figure 8:
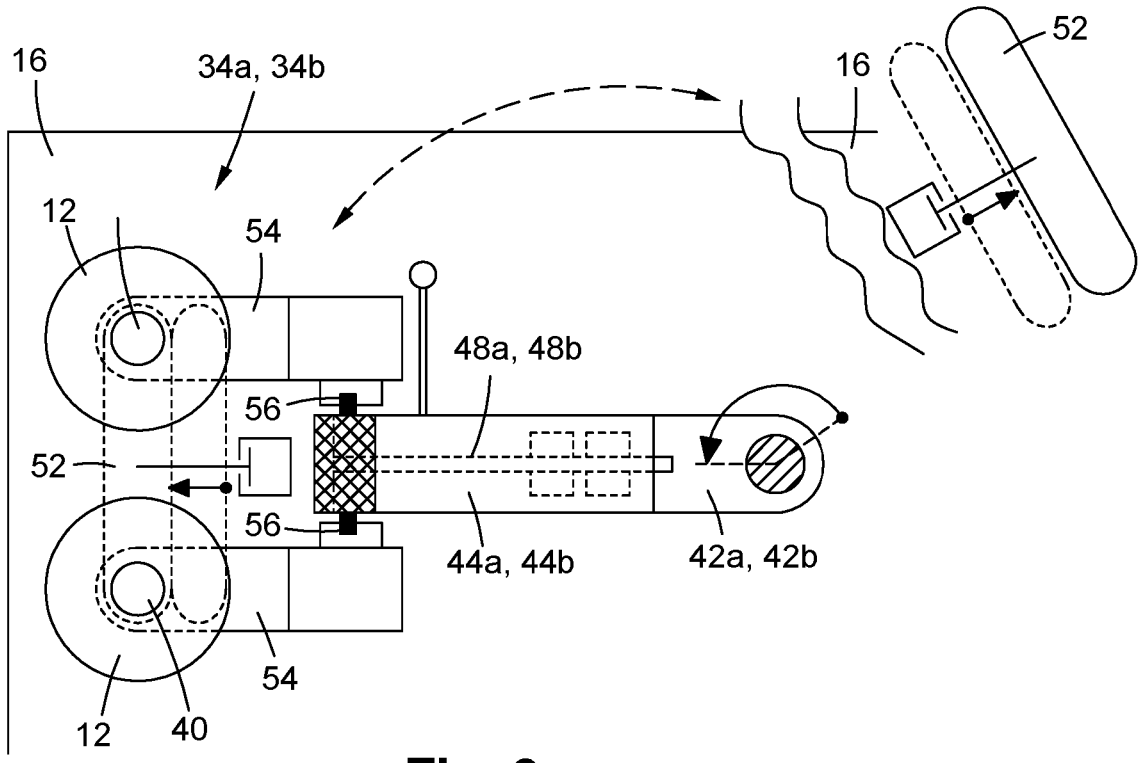
Figure 9:
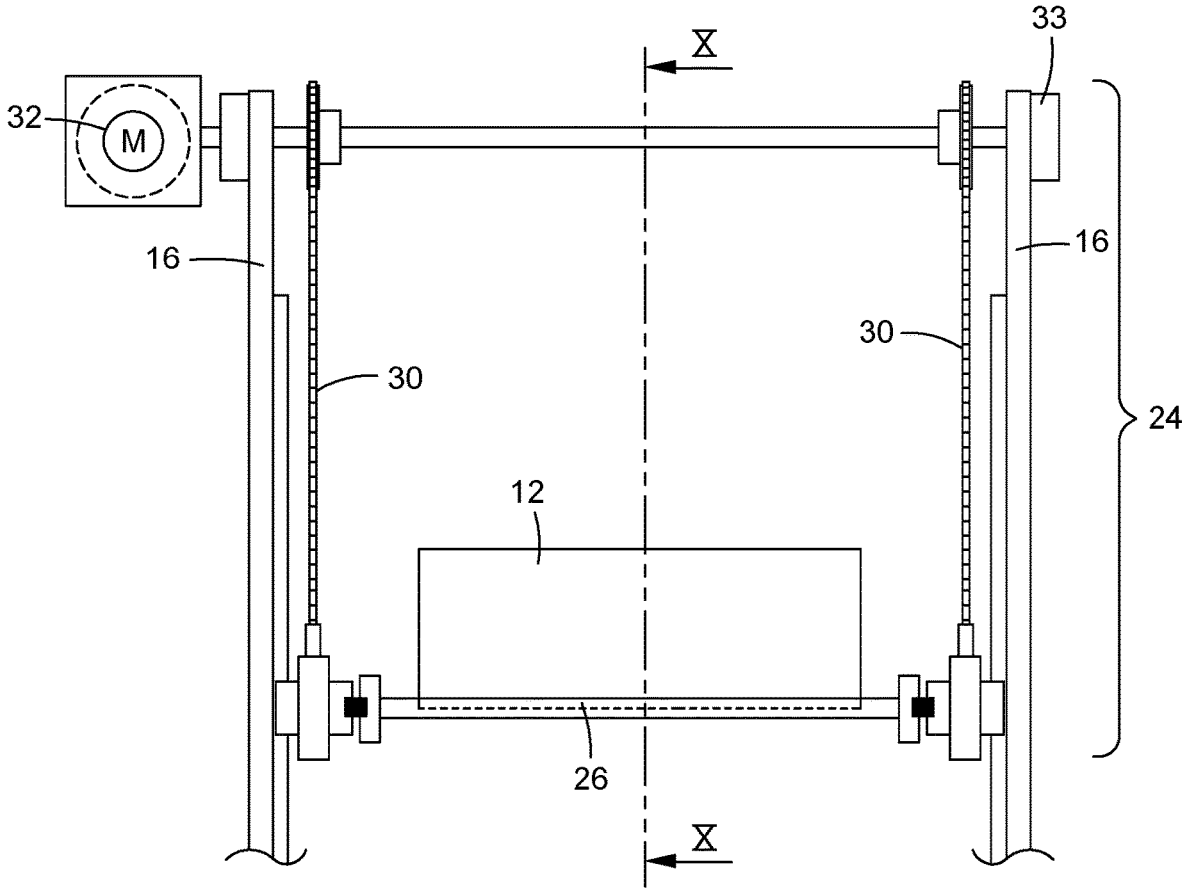
Figure 10:
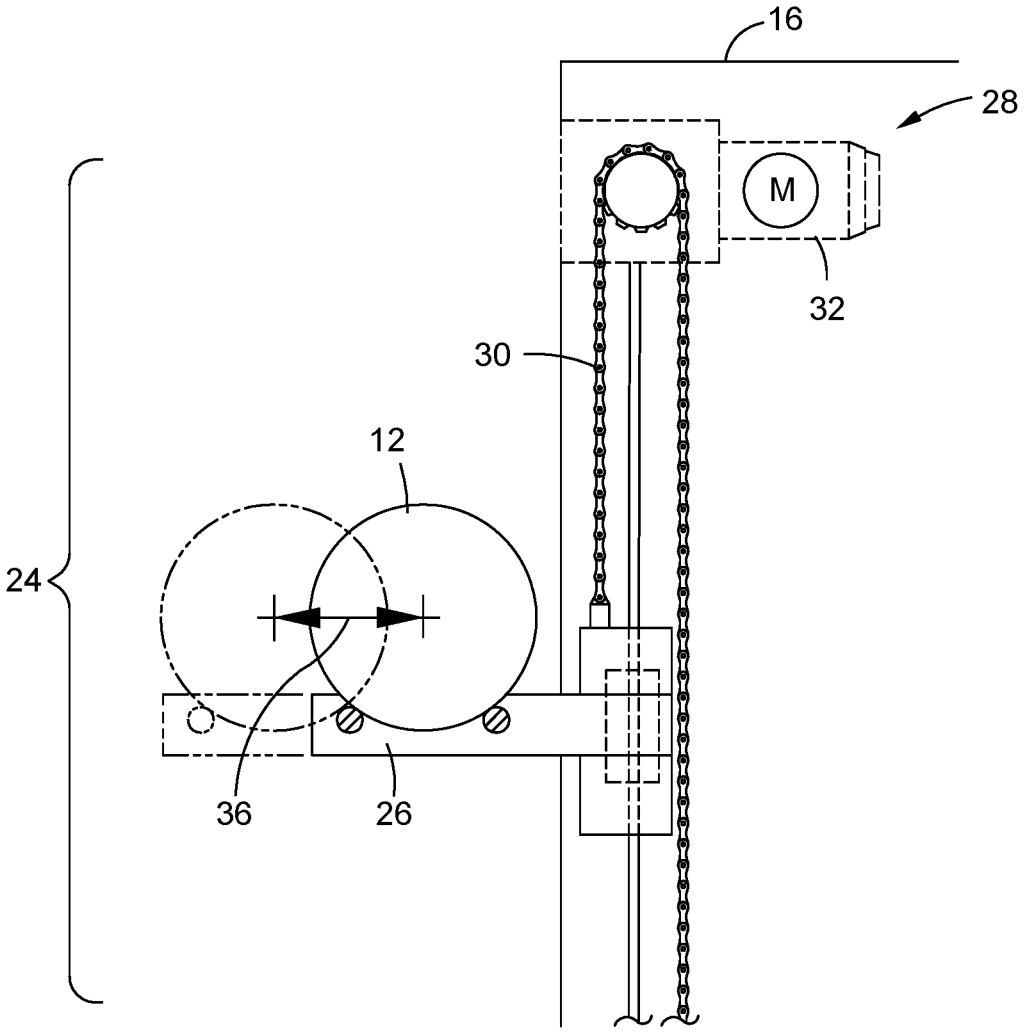
Figure 11:
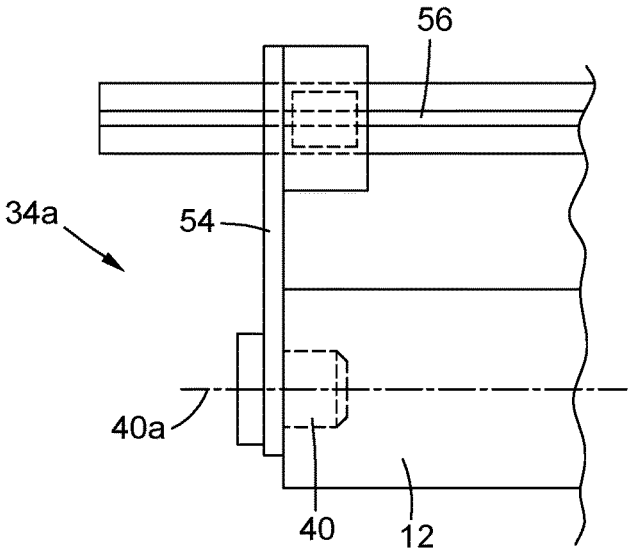
Figure 12:
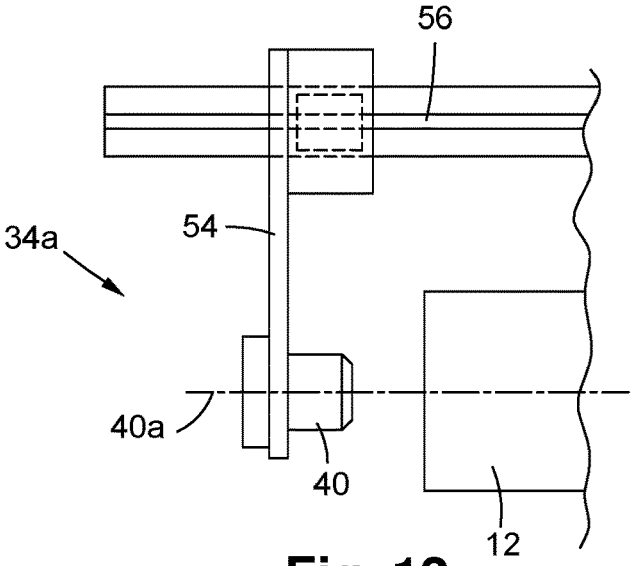
Figure 13:
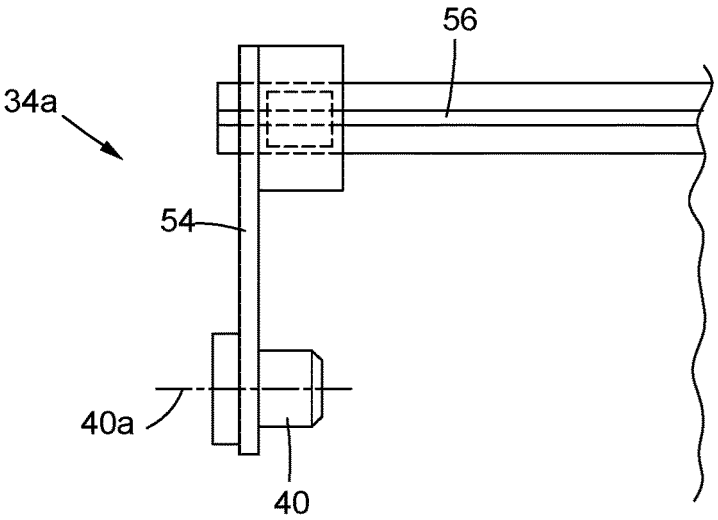

The invention will now be explained with reference to different embodiments which are shown in the attached drawings. In the drawings, FIG. 1 shows a portion of a hotfoil stamping machine according to the invention comprising a reel support assembly according to the invention, wherein a support element of an elevator unit of the reel support assembly is in a storage position, FIG. 2 shows the portion of the hotfoil stamping machine of FIG. 1, wherein the support element of the elevator unit of the reel support assembly is in an alignment state, FIG. 3 shows the portion of the hotfoil stamping machine of FIGS. 1 and 2, wherein the support element of the elevator unit of the reel support assembly is in a loading state, FIG. 4 shows a sectional view of the hotfoil stamping machine of FIG. 2, FIG. 5 shows a detail of the reel support assemblies of FIGS. 1 to 4, wherein a first support arm unit of the reel support assembly is in an operational position, FIG. 6 shows the detail of FIG. 5, wherein the first support arm unit of the reel support assembly is in an intermediate position, FIG. 7 shows the detail of FIGS. 5 and 6, wherein the first support arm unit of the reel support assembly is in an extended position, FIG. 8 shows the detail of FIGS. 5 to 7 together with two safeguard bars being in two different positions respectively, FIG. 9 shows an elevator unit of the reel support assemblies shown in FIGS. 1 to 4 in a separate view, FIG. 10 shows the elevator unit of FIG. 9 seen along direction X in FIG. 9, FIG. 11 shows a detail of the reel support assemblies of FIGS. 1 to 4 relating to the mounting of a reel to the reel support assembly, wherein a holding stub is engaged with a reel, FIG. 12 shows the detail of FIG. 11, wherein the holding stub is disengaged from the reel, and FIG. 13 shows the detail of FIGS. 11 and 12, wherein the reel is withdrawn from the reel support assembly.

FIG. 1 shows an end portion 10*a* of a hotfoil stamping machine 10.

In terms of a web travelling direction in a hotfoil stamping process being performed by the hotfoil stamping machine 10, the end portion 10*a* corresponds to an upstream end of the hotfoil stamping machine 10.

This means, at this end portion 10*a* reels 12 to be processed are provided, wherein at an opposed end, i.e. at a downstream end, products made by the hotfoil stamping machine 10 are provided.

In this context, a reel 12 usually comprises a reel core on which a web is wound, e.g. a foil to be processed in the hotfoil stamping machine 10.

Depending on the hotfoil stamping process to be performed, one or more reels 12 can be supported in the hotfoil stamping machine 10 by a reel support assembly 14.

In the present examples, the hotfoil stamping machine 10 and the reel support assembly 14 use a shared support frame 16, i.e. a support frame of the hotfoil stamping machine 10 serves as a support frame of the reel support assembly 14.

Moreover, the hotfoil stamping machine 10 of the present example is partially surrounded by a platform 18 for operators which is limited by a handrail 20 and a gate 22.

In the vicinity of the end portion 10*a* the platform 18 comprises a pivoting gangway 23 which can be selectively pivoted out of the way as can best be seen from a comparison of FIGS. 1 and 3.

The reel support assembly 14 comprises an elevator unit 24 having a support element 26 on which a reel 12 may be placed.

The support element 26 is supported on the support frame 16 in a vertically movable manner.

To this end the support element 26 is coupled to a chain drive 28 comprising a chain 30 and a drive motor 32 for operating the chain 30 (cf. FIGS. 9 and 10).

Using the chain drive 28 the support element 26 can be moved into a storage position as shown in FIG. 1. This position substantially corresponds to the top position being reachable by using the chain drive 28.

The support element 26 is preferably placed in the storage position if the hotfoil stamping machine 10 is loaded with the needed reels 12 and is performing a hotfoil stamping process using these reels 12.

Alternatively, the support element 26 is placed in the storage position if the hotfoil stamping machine 10 is not operational, or if the lift is not used so as to keep some free space to allow the operator to handle light reels by hand and bypass the elevator unit 24.

Alternatively, the support element 26 can be moved into an alignment state as shown in FIG. 2. In this state the support element 26 is arranged at a height such that the reel 12 placed on the support element 26 or a reel 12 to be received on the support element 26 is aligned with corresponding support arms units 34*a*, 34*b* of the reel support assembly 14 as will be explained in detail below.

The support element 26 can also assume a loading state as shown in FIG. 3.

In this state the support element 26 is placed close to a floor, such that the reel 12 placed thereon can be easily withdrawn from the support element 26. Obviously, placing a reel 12 on an empty support element 26 being in the loading state is also possible.

In this context, the support element 26 is also horizontally movable along a direction indicated by arrow 36 in FIG. 10.

This allows to load a first reel 12 in a lower stub 40 of the respective arm units 34*a*, 34*b* first, and to load a second reel in the upper stub 40 of the arm units 34*a*, 34*b* thereafter.

The first reel 12 is loaded on the arm units 34*a*, 34*b* and the arm units 34*a*, 34*b* are set into the intermediate position (cf. FIG. 6).

Then, the second reel 12 is loaded on the support element 26 close to the floor, i.e. in the loading position. The support element 26 is elevated and must be moved away from the end portion 10*a* along the direction indicated by arrow 36 to pass next to the first reel 12.

To load the second reel 12 on the arm units 34*a*, 34*b*, the support element 26 must be brought back toward the end portion 10*a* along the direction indicated by arrow 36 once the support element 26 has reached the alignment height.

In other words, the second reel 12 can be moved around the first reel 12.

It is noted that in the example of FIGS. 1 to 4 the gangway 23 may be folded away such that the support element 26 can be placed in close proximity to the floor, i.e. in the loading state (see especially FIG. 3).

Moreover, the gate 22 is adapted for being opened such that the support element 26 may be accessed in order to withdraw a reel 12 therefrom or in order to place a reel 12 thereon.

For safety reasons, the elevator unit 24 also comprises a brake unit 33, preferably two brake units. In the latter case one of the brake units may be integrated into the drive motor 32 (cf. FIG. 9).

These brake units 33 are used for selectively blocking the chain 30.

The brake unit 33 and the brake unit integrated into the drive motor 32 are normally closed. Thus, the support element 26 is only movable if the brake units assume an activated condition. In other words, in the absence of an activation, e.g. in the absence of the necessary electricity, the brake units are closed and renders the support element 26 immovable.

As has already been mentioned, the reel support assembly 14 comprises a first support arm unit 34*a* and a second support arm unit 34*b* (see FIG. 2).

The second support arm unit 34*b* is arranged opposite the first support arm unit 34*a* such that a reel 12 can be supported between the first support arm unit 34*a* and the second support arm unit 34*b*.

Furthermore, the first support arm unit 34*a* and the second support arm unit 34*b* are adapted for moving in synchronization.

The first support arm unit 34*a* and the second support arm unit 34*b* will be explained in detail with reference to FIGS. 5 to 7, wherein strictly speaking these Figures only show the first support arm unit 34*a*. However, since the second support arm unit 34*b* is identical to the first support arm unit 34*a* except for the fact of being mirror-inverted, also the reference signs relating to the second support arm unit 34*b* will be used.

In the example shown, both support arm units 34*a*, 34*b* have two holding stubs 40 for mounting a reel 12 thereon. One of the stubs 40 is represented as an upper stub and the other one of the stubs 40 is represented as a lower stub.

Each support arm unit 34*a*, 34*b* comprises a respective first arm piece 42*a*, 42*b* being rotatably supported on the support frame 16 and a second arm piece 44*a*, 44*b* being slidably supported on the first arm piece 42*a*, 42*b*.

Thus, the first support arm unit 34*a* and the second support arm unit 34*b* are pivotably supported on the support frame 16 via the respective first arm pieces 42*a*, 42*b*.

Furthermore, the first support arm unit 34*a* and the second support arm unit 34*b* are translatorily supported on the support frame 16 because the second arm pieces 44*a*, 44*b* are slidably supported on the respective first arm pieces 42*a*, 42*b*.

To this end, the respective first arm pieces 42*a*, 42*b* are connected to the respective second arm pieces 44*a*, 44*b* via sliding rails 48*a*, 48*b* being oriented along a direction of translatory extension of the respective support arm unit 34*a*, 34*b*.

Using the degrees of movability provided by the pivotal support on the support frame 16 and the extendability, the first support arm unit 34*a* and the second support arm unit 34*b* can be brought into an operational position in that the support arm units 34*a*, 34*b* are in a first pivotal position with respect to the support frame 16 and non-extended (cf. FIG. 5).

In this position, web wound on the reels 12 can be withdrawn therefrom for processing it within the hotfoil stamping machine 10. Different paths of the web being withdrawn from the reels 12 are generally designated by reference sign 50.

The first support arm unit 34*a* and the second support arm unit 34*b* can also be brought into an intermediate position in that the support arm units 34*a*, 34*b* are in a second pivotal position and non-extended (cf. FIG. 6). Thus, as compared to the operational position of FIG. 6 the support arm units 34*a*, 34*b* and the reels mounted thereon are just pivoted.

Possible paths of the web being withdrawn from the reels 12 are again designated by reference sign 50.

Moreover, the first support arm unit 34*a* and the second support arm unit 34*b* can also be brought into an extended position in that the support arm units 34*a*, 34*b* are in a second pivotal position with respect to the support frame and extended (cf. FIG. 7).

As compared to the intermediate position, the support arm units 34*a*, 34*b* are not further pivoted but just extended, as depicted in FIG. 8.

In the extended position the reels 12 may be handed over from the respective holding stubs 40 of the support arm units 34*a*, 34*b* to the supporting element 26 of the elevator unit 24 and vice versa.

To this end, the holding stubs 40 and corresponding holding pieces 54 are supported on the respective support arm unit 34*a*, 34*b* via a rail 56 extending substantially parallel to a middle axis 40*a* of the respective holding stub 40.

It is understood that also a plurality of parallel rails may be used for the same purpose.

Thus, the holding stubs 40 are movable in a direction substantially corresponding to their middle axis 40*a* such that the stubs 40 can be selectively extended into cooperation with a reel 12 to be mounted on the respective support arm unit (cf. FIG. 11).

If the reel 12 is to be withdrawn from the support arm units 34*a*, 34*b*, the holding stubs 40 may be withdrawn from the core of the reel 12 by moving them along the rail 56 (cf. FIG. 12).

In this condition, the reel can be separated and withdrawn from the holding arm units 34*a*, 34*b* (cf. FIG. 13).

This may be done by using the supporting element 26.

Several sets of arms 34*a*, 34*b* can be used on a single rail 56 to position several reels along a single axis 40*a*. Please note that a single arm 34*a* can be used to hold a narrow reel, while to arms 34*a*, 34*b* are needed to hold wide, heavy reels.

FIG. 8 shows a variant in which on the support frame 16 two safeguard bars 52 are arranged for selectively occupying a space into which a holding stub 40 may be positioned if not correctly adjusted.

The space may be occupied by a holding stub 40 when the holding stub 40 is not correctly or not completely inserted into the reel 12. The safeguard bar is briefly moved from its retracted position into the extended position. When the space is occupied by a holding stub 40, the safeguard bar 52 is prevented to extend, and thus the safety system of the reel support assembly 14 can prevent any pivoting of the support arm unit 34 until the problem is fixed.

The hotfoil stamping machine 10 can thus be operated as follows.

For the ease of explanation, a condition in which there are no reels 12 in the hotfoil stamping machine 10 will be taken as a starting point.

Moreover, in this starting point the supporting element 26 is in the storage position and the support arm units 34*a*, 34*b* are in the operational position (cf. FIG. 1).

If a reel 12 is to be loaded into the hotfoil stamping machine 10, the supporting element 26 is lowered to the loading position (cf. FIG. 3) and a reel 12 is placed thereon.

Subsequently, the support arm units 34*a*, 34*b* are brought into the extended position (cf. FIG. 7).

The holding stubs 40 are brought into a condition corresponding to FIGS. 12 and 13 such that they provide enough space for a reel 12 to be placed therebetween.

Thereafter, the supporting element 26 is brought into the alignment condition. Thus, the reel 12 is placed such that the holding stubs 40 can be moved into the center of a core thereof (cf. FIG. 11).

After this, the supporting element 26 is lowered such that it does not support the reel 12 any more and especially does not block a horizontal movement thereof.

Then the holding arm units 34*a*, 34*b* can be brought from their extended position (cf. FIG. 7) to the intermediate position (cf. FIG. 6) and from there to the operational position (cf. FIG. 5).

Now the web wound on the reel 12 can be used for a hotfoil stamping process.

If the reel 12 is to be withdrawn from the hotfoil stamping machine 10 the steps of the above process are simply performed in an inverted order.

The invention claimed is:

1. A reel support assembly for a web material processing machine, comprising:

a support frame and at least a first support arm unit, having at least one holding stub for mounting the reel on the first support arm unit, wherein the first support arm unit is directly supported on the support frame, and an elevator unit having a support element on which the reel may be placed, wherein the support element is supported on the support frame in a vertically movable manner, wherein the first support arm unit is pivotably and/or translatorily supported on the support frame, and wherein the support element is coupled to the support frame via a chain drive or a belt drive.

2. The reel support assembly according to claim 1, further comprising:

a second support arm unit, having at least one holding stub for mounting the reel on the second support arm unit, wherein the second support arm unit is supported on the support frame and wherein the second support arm unit is arranged opposite the first support arm unit such that a reel can be supported between the first support arm unit and the second support arm unit.

3. The reel support assembly according to claim 2, wherein the at least one holding stub of the first support arm unit and the at least one holding stub of the second support arm unit are movable in a direction substantially corresponding to their middle axis such that the holding stubs can be selectively extended into cooperation with the reel to be mounted on the respective support arm unit and withdrawn therefrom.

4. The reel support assembly according to claim 3, wherein the holding stubs are supported on the respective support arm unit via a rail extending substantially parallel to the middle axis of the respective holding stub.

5. The reel support assembly according to claim 1, wherein the elevator unit comprises a brake unit which is normally closed such that the support element is only movable if the brake unit assumes an activated condition.

6. The reel support assembly according to claim 2, wherein the second support arm unit is pivotably and/or translatorily supported on the support frame.

7. The reel support assembly according to claim 2, wherein each of the support arm units comprises a first arm piece being rotatably supported on the support frame and a second arm piece being slidably supported on the first arm piece.

8. The reel support assembly according to claim 7, wherein the first arm piece and the second arm piece are connected via a sliding rail being oriented along a direction of slidable support of the respective support arm unit.

9. The reel support assembly according to claim 8, wherein the first arm piece and the second arm piece are connected via two substantially parallel sliding rails.

10. The reel support assembly according to claim 2, wherein each of the support arm units comprises at least two holding stubs for respectively mounting the reel to the support arm unit.

11. The reel support assembly according to claim 1, further comprising:

at least one safeguard bar selectively occupying an exclusion space into which a stub supporting the reel is not to be moved.

12. The reel support assembly according to claim 1, wherein the support element is horizontally movable.

13. A hotfoil stamping machine comprising the reel support assembly according to claim 1, wherein the reel support assembly is arranged at an upstream end of the hotfoil stamping machine with respect to a web travelling direction.

14. The hotfoil stamping machine according to claim 13, wherein a support frame of the hotfoil stamping machine serves as the support frame of the reel support assembly.

15. A hotfoil stamping machine including a reel support assembly comprising:

a support frame and at least a first support arm unit, having at least one holding stub for mounting the reel on the first support arm unit, wherein the first support arm unit is directly supported on the support frame, and an elevator unit having a support element on which the reel may be placed, wherein the support element is supported on the support frame in a vertically movable manner, wherein the first support arm unit is pivotably and/or translatorily supported on the support frame, wherein the reel support assembly is arranged at an upstream end of the hotfoil stamping machine with respect to a web travelling direction, and wherein a support frame of the hotfoil stamping machine serves as the support frame of the reel support assembly.

16. The hotfoil stamping machine according to claim 15, wherein the reel support assembly further comprises:

a second support arm unit, having at least one holding stub for mounting the reel on the second support arm unit, wherein the second support arm unit is supported on the support frame and wherein the second support arm unit is arranged opposite the first support arm unit such that a reel can be supported between the first support arm unit and the second support arm unit.

17. The hotfoil stamping machine according to claim 15, wherein the support element is coupled to the support frame via a chain drive or a belt drive.

18. A reel support assembly for a web material processing machine comprising:

a support frame and at least a first support arm unit, having at least one holding stub for mounting the reel on the first support arm unit, wherein the first support arm unit is directly supported on the support frame, an elevator unit having a support element on which the reel may be placed, wherein the support element is supported on the support frame in a vertically movable manner, and a second support arm unit, having at least one holding stub for mounting the reel on the second support arm unit, wherein the second support arm unit is supported on the support frame, wherein the first support arm unit is pivotably and/or translatorily supported on the support frame, wherein the second support arm unit is arranged opposite the first support arm unit such that a reel can be supported between the first support arm unit and the second support arm unit, wherein each of the support arm units comprises at least two holding stubs for respectively mounting the reel to the support arm unit.

19. The reel support assembly according to claim 18, wherein the support element is coupled to the support frame via a chain drive or a belt drive.

20. The reel support assembly according to claim 18, wherein the reel support assembly is arranged at an upstream end of the web material processing machine with respect to a web travelling direction, and wherein a support frame of the web material processing machine serves as the support frame of the reel support assembly.

* * * * *